US006056038A

United States Patent [19]

Foster et al.

[11] Patent Number: 6,056,038

[45] Date of Patent: May 2, 2000

[54] RETRACTABLE BARRIER

[75] Inventors: James D. Foster, Arlington; Paul E. Brefka, Southborough, both of Mass.

[73] Assignee: Allset, Incorporated, Arlington, Mass.

[21] Appl. No.: 09/138,173

[22] Filed: Aug. 21, 1998

Related U.S. Application Data

[60] Provisional application No. 60/056,530, Aug. 21, 1997, provisional application No. 60/072,681, Jan. 27, 1998, and provisional application No. 60/082,088, Apr. 17, 1998.

[51] Int. Cl.[7] ..... A47G 5/00

[52] U.S. Cl. ..... 160/351; 160/240; 160/372; 160/373; 49/55; 256/26

[58] Field of Search ..... 160/31, 99, 100, 160/240, 244, 266, 290.1, 300, 351, 372, 373, 371, 375, 369, 210, 160, 217, 220, 381; 49/55, 57, 465; 256/26, DIG. 1

[56] References Cited

U.S. PATENT DOCUMENTS

| | | | |
|---|---|---|---|
| 113,537 | 4/1871 | Linscott | 160/240 X |
| 193,573 | 7/1877 | Tripp . | |
| 1,153,015 | 9/1915 | Bauer | 160/300 |
| 1,922,286 | 8/1933 | Gronbech | 160/99 |
| 2,131,521 | 9/1938 | Nye | 160/31 |
| 2,182,396 | 12/1939 | Copp | 160/372 |
| 3,050,742 | 8/1962 | Munson | 4/154 |
| 3,065,785 | 11/1962 | Taber | 160/290.1 X |
| 3,068,937 | 12/1962 | Christensen | 160/41 |
| 3,803,943 | 4/1974 | Woloszyk | 74/612 |
| 3,911,990 | 10/1975 | Hoover et al. | 160/100 |
| 4,588,223 | 5/1986 | Lendenyl | 296/24 |
| 4,930,834 | 6/1990 | Moore | 296/50 |
| 5,110,172 | 5/1992 | Ney et al. | 296/50 |
| 5,207,260 | 5/1993 | Commesso | 160/135 |
| 5,271,656 | 12/1993 | Hull et al. | 296/180.1 |
| 5,288,122 | 2/1994 | Pilhall | 296/24.1 |
| 5,437,134 | 8/1995 | Donnelly | 49/55 X |
| 5,505,244 | 4/1996 | Thumann | 160/23.1 |
| 5,531,258 | 7/1996 | Poulson et al. | 160/376 |
| 5,551,726 | 9/1996 | Ament | 280/749 |
| 5,570,543 | 11/1996 | Bishop | 49/465 |
| 5,575,113 | 11/1996 | Huang | 49/55 |
| 5,632,520 | 5/1997 | Butz | 296/24.1 |
| 5,636,679 | 6/1997 | Miller et al. | 160/317 |
| 5,657,809 | 8/1997 | Longoria et al. | 49/465 X |
| 5,671,790 | 9/1997 | Andersen et al. | 160/31 X |
| 5,704,164 | 1/1998 | Huang | 49/55 |
| 5,868,191 | 2/1999 | Blackmon, Jr. | 160/240 X |

FOREIGN PATENT DOCUMENTS

| | | |
|---|---|---|
| 2 129 473 | 5/1984 | United Kingdom . |
| WO 97/17004 | 5/1997 | WIPO . |

OTHER PUBLICATIONS

Catalogue "Metallbaubeschlage", GAH Alberts, Prospekt Gruppe 41–185/961, 1996.

*Primary Examiner*—Daniel P. Stodola
*Assistant Examiner*—Bruce A. Lev
*Attorney, Agent, or Firm*—Foley, Hoag & Eliot, LLP

[57] ABSTRACT

A safety barrier comprising a support, a partition frame hingedly connected to the support, and a retractable membrane attached to one end of the partition frame. The partition frame and the support can be extended across an opening, such as a doorway, to securely position the barrier within the opening. The partition frame includes a first member hingedly connected to the support and a second member slidingly engaged to the first member. The retractable member may be deployed toward an opposite end of the partition frame to close off the opening.

4 Claims, 4 Drawing Sheets

RETRACTABLE BARRIER

RELATED U.S. APPLICATION(S)

The present application claims priority from U.S. Provisional Application Nos. 60/056,530, filed Aug. 21, 1997, 60/072,681, filed Jan. 27, 1998, and 60/082,088, filed Apr. 17, 1998, all of which are hereby incorporated herein by reference.

TECHNICAL FIELD

This invention relates to safety barriers, and in particular to retractable and removable barriers, which may be positioned across an opening for use as safety restraints or to prevent passage therethrough.

BACKGROUND ART

Retractable partitioning screens or gates are currently available for use as portable safety barriers, so that, for example, a potentially dangerous area may be temporarily closed off or an opening to a restricted area may be temporarily blocked, thereby preventing an object from accessing the potentially dangerous or restricted area. When the restriction is no longer necessary, these partitioning screens or gates can be conveniently retracted and removed, and access to the area restored. The retractable partitioning screens or gates are typically manufactured from a flexible membrane, for instance, a resilient fabric or plastic, so that the membrane may be retracted within a housing when not in use. The use of a flexible membrane, however, can, at times, compromise the ability of the partitioning screen or gate to act as a safety barrier. In particular, a flexible partitioning screen or gate, although sufficiently taut when extended, may nevertheless remain flexible along the edges. As a result, if, for instance, a child leans against a top edge of the retractable gate, his weight may not be properly supported along the top edge, and the child may ultimately fall across and over the retractable gate. In addition, the flexible nature of the membrane allows any force acting on a surface and or and edge of the membrane to be magnified toward the gate's mounts. For example, constant leaning and pulling on the retractable membrane by, for instance, a child, could compromise the integrity of the mounts and therefore the security and positioning of the gate within the opening. Moreover, many flexible barriers lack one-handed operation once the barriers have been secured within the opening. As a result, the safety of the user, including that a child, if the user were to carry the child, may be compromised.

There are available partitioning barriers made from a rigid material, such as wood or molded plastic, which can avoid the problems associated with flexible retractable barriers. These rigid barriers, however, are typically large and/or cumbersome, and may not have the portability and convenience of a flexible retractable barrier. In addition, if blockage of an opening (i.e., a doorway) is only needed on a periodic basis, it may be inconvenient to repeatedly remove these cumbersome barriers from the opening, just so that a pathway can be cleared for passage therethrough. The need to repeatedly remove these barriers can cause the barriers to be used in ways that would compromise the protection which the barriers were designed to provide. For example to avoid repeated removal, a barrier may be left semi-permanently in place or for an extended period, even when there is not a need for the barrier. As a result, a person needing to go through the opening, in order to decrease the amount of time needed to walk along a different path to avoid the barrier, may jump or step over the barrier, an act which may cause the person to trip and hurt himself. If, on the other hand, the barrier is removed for an extended period to avoid repeated removal, the need to walk around, or the need to step over the barrier, the safety of the user and others may be unnecessarily compromised when restriction across the opening again becomes necessary.

Accordingly, it is desirable to provide a barrier which can be conveniently used and which does not compromise safety of the user for convenience.

SUMMARY OF THE INVENTION

The present invention provides, in accordance with one embodiment, a safety barrier to prevent passage of an object across an opening. The barrier includes an extendable partition frame for placement within the opening. The partition frame includes a first member, and a second member that is slidingly engaged to the first member, so as to permit the length of partition frame to be adjustable along the opening. The first member may be provided with a top arm and a bottom arm, each extending partially along the opening and being substantially parallel to one another. The second member may also be provided with a top arm and a bottom arm that are similarly parallel to the arms of the first member. In this manner, the top and bottom arms of the second member may slidingly engage the top and bottom arms of the first member.

The barrier also includes a support connected to the partition frame to maintain the partition frame within the opening. In a preferred embodiment, the first member of the partition frame is hingedly mounted to the support, so that movement of the partition frame about the support defines an arc that is transverse to a plane in which the support sits. In other words, the partition frame is capable of swinging like a door across the opening. The support, similar to the partition frame, may be provided with the ability to extend along the opening. In one embodiment, the support includes a portion that is movable across the opening to define a position to which the second member may extend.

The barrier of the present invention further includes a retractable partition membrane attached to the partition frame at an end connected to the support, such that the membrane may be deployed toward an end of the partition frame opposite the support to form a partition across the opening. The retractable membrane, in one embodiment, may be mounted on a spring loaded rod to permit the membrane to be self-retracting.

The barrier may also include a mechanism for securely positioning the barrier within the opening. An example of a mechanism contemplated for use with the present invention is a pressure pad disposed, for instance, on the support and the second member. Thus, for example, when the partition frame is substantially fully extended in the opening, such as a doorway, the pressure pads can engage the sides of the doorway to secure the barrier within the doorway.

To prevent passage across an opening, in accordance with one embodiment of the present invention, the safety barrier is placed within the opening so that the support is positioned against one side of the opening. Thereafter, the second member of the partition frame may be slidingly moved along the opening to a predetermined position away from the first member. The retractable membrane may next be pulled toward the second member and secured against the second member, so as to close off the opening. In an alternate embodiment, the retractable membrane may be secured against the second member prior to the second member being pulled along the opening. To this end, the retractable membrane may be extended as the second member is being moved along the opening.

With the barrier securely positioned within the opening, the partition frame may be operated in a manner similar to a door. Specifically, when in an open position, the partition frame permits passage through the opening, whereas in a closed position, the partition frame acts as a barrier to prevent passage across the opening.

DETAILED DESCRIPTION OF SPECIFIC EMBODIMENTS

Figure 1:
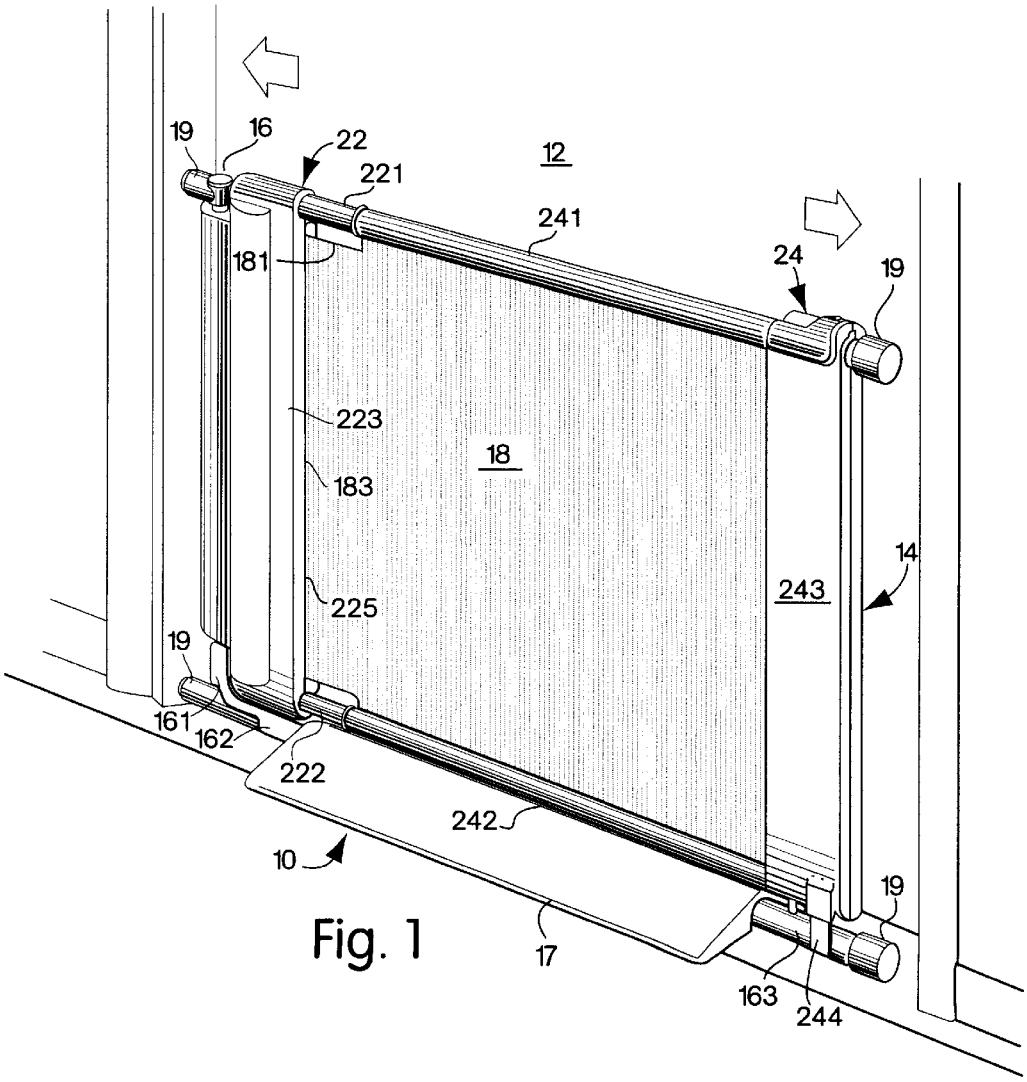
FIGS. 1 and 2 illustrate a retractable safety barrier in accordance with one embodiment of the present invention.
Figure 2:
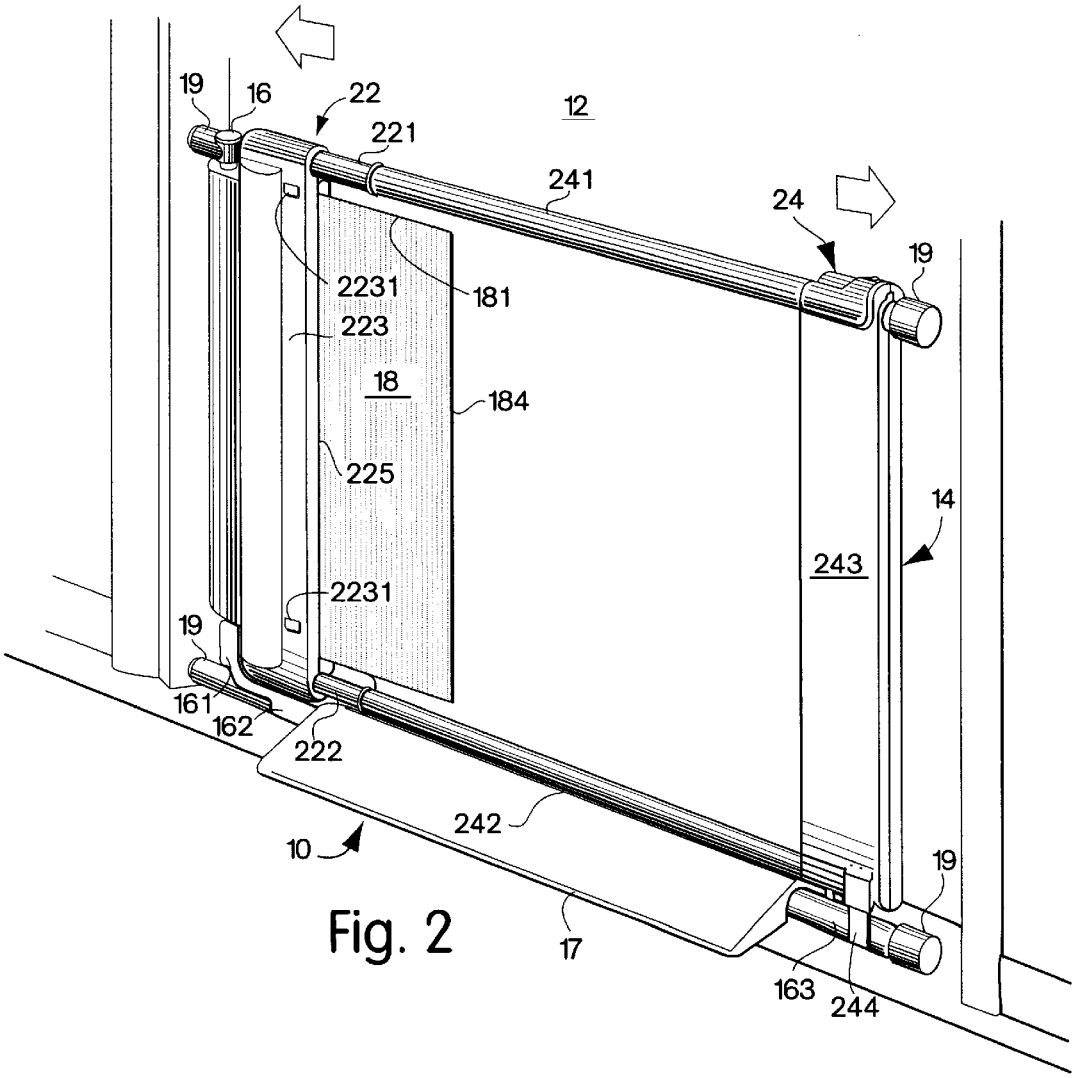

Referring now to the drawings, FIGS. 1 and 2 illustrate a safety barrier 10, in accordance with one embodiment of the present invention. The barrier 10 can be used as a portable barrier for home use, so that a certain area may be temporarily closed off or an opening 12 to a restricted area may be temporarily blocked to prevent, for example, an infant, a toddler or a pet, from accessing a restricted area. The barrier 10 includes, among other things, an extendable partition frame 14. The partition frame 14, as shown in FIG. 2, may be provided with a first member 22 and a second member 24 that is slidingly engaged to the first member 22. By permitting the second member 24 to slidingly engage the first member 22, the length of partition frame 14 can be appropriately adjusted according to the size of the opening 12 within which the barrier 10 is positioned.

The first member 22 of the partition frame 14, in one embodiment, includes a top arm 221 and a bottom arm 222, both of which are substantially parallel to one another. The top arm 221 and the bottom arm 222 project from a housing 223, and from the perspective of FIG. 1, extend along a plane defined by the opening 12. Likewise, the second member 24 includes a top arm 241 and a bottom arm 242, both of which extend from a housing 243. The top arm 241 and bottom arm 242 of the second member 24 are similarly parallel to the arms of the first member 22. In this manner, the arms of the second member 24 may slidingly engage the arms of the first member 22. It should be appreciated that the arms of the second member 24 may be sized to fit over the arms of the first member 22 or, alternatively, into the arms of the first member 22, or in any manner which would permit them to slidingly engage the arms of the first member 22.

Figure 3:
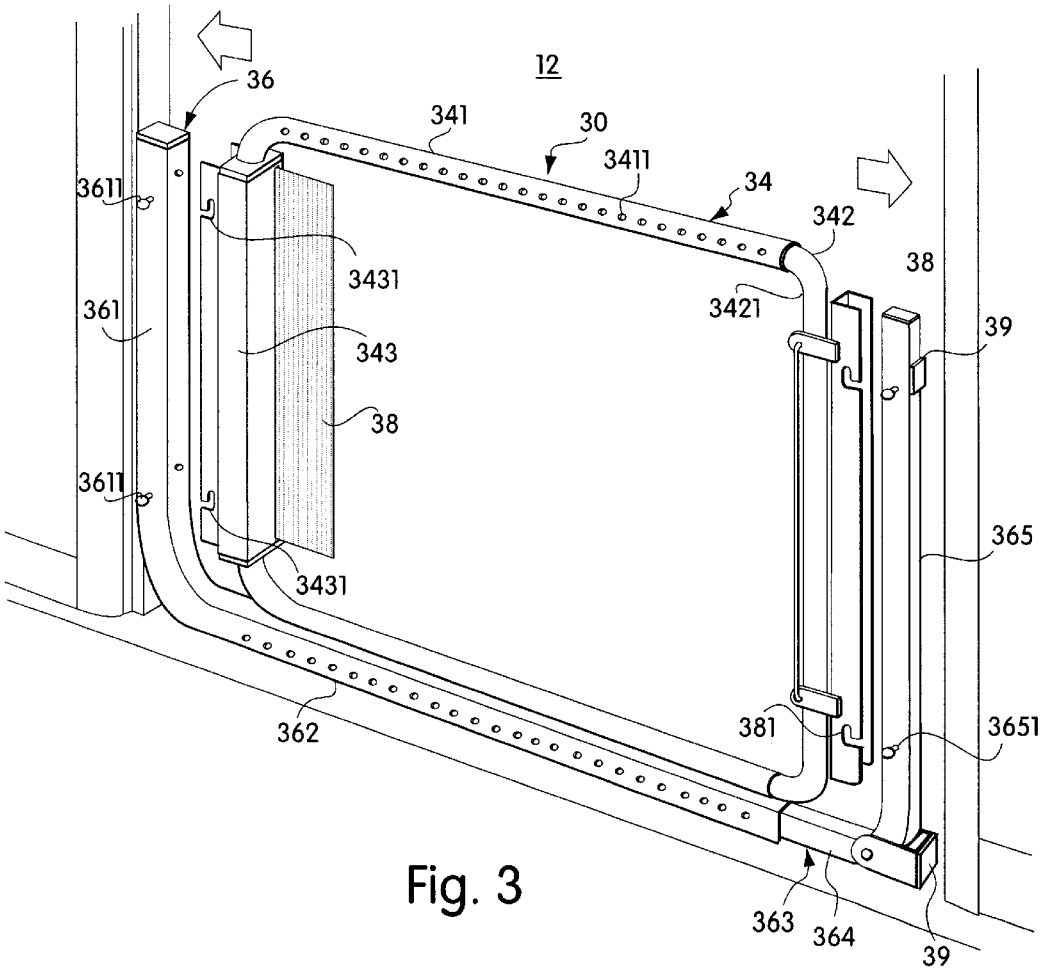
FIG. 3 illustrates a retractable safety barrier in accordance with another embodiment of the present invention.

To secure the position of the second member 24 as it extends from the first member 22, in one embodiment of the invention, one of the first and second members may be provided with biasing buttons on its arms, and other member may be provided with a series of complimentary holes 3411 on its arms for receiving the button (FIG. 3). In this manner, when the button is pushed in and away from the hole 3411, the second member 24 may be incrementally moved to the next hole 3411, where the button will extend through the hole to secure the portion of the second member 24.

The first member 22 of the partition frame 14, as shown in FIG. 1, is connected to a support 16, which acts to maintain the partition frame 14 within the opening 12. The support 16 preferably includes a vertical section 161 to which the first member 22 is connected, and a horizontal section 162, above which the first member 22 is positioned. In a preferred embodiment, the first member 22 is hingedly connected to the vertical section 161 of the support 16, so that movement of the partition frame 14 about the vertical section 161 defines an arc that is transverse to the plane defined by opening 12. In other words, the partition frame 14, when connected to the vertical section 161 of the support 16, may move between a closed position and an open position, similar to that exhibits by a door. When in the closed position, as seen in FIG. 1, the partition frame 14 and the support 16 are positioned substantially within the plane defined by the opening 12.

The support 16, like the partition frame 14, may be provided with the ability to extend along the opening 12. In one embodiment, the support 16 includes a portion 163, which is movably engaged to the horizontal section 162, for extending along the opening 12 to define a position to which the second member 24 of the partition frame 14 may extend. The portion 163 may be designed to extend from the horizontal section 162 independently or simultaneously with the second member 24 of the partition frame 14 as the second member 24 extends away from the first member 22. In particular, the portion 163 may extend from the support 16 in a sliding motion, or alternatively, in an incremental manner, such as by screw fitting, or by the manner similar to that discussed above in connection with members of the partition frame 14.

In one embodiment of the invention, a device 244 may be provided to permit the user to define the direction toward which the partition frame 14 may swing. The device 244 can be a retractable bar, a pivoting bar, or other known stopper devices, positioned on each side of the second member 24, or, alternatively, positioned on each side of the portion 163. The device 244, when in the extended position shown in FIG. 1 (with the other side retracted), prevents the partition frame 14 from swinging toward the other side of the opening 12 where, for example, there may be possible dangers. The direction of swing may be reversed by extending the device 244 in a manner opposite that shown in FIG. 1.

Figure 4B:
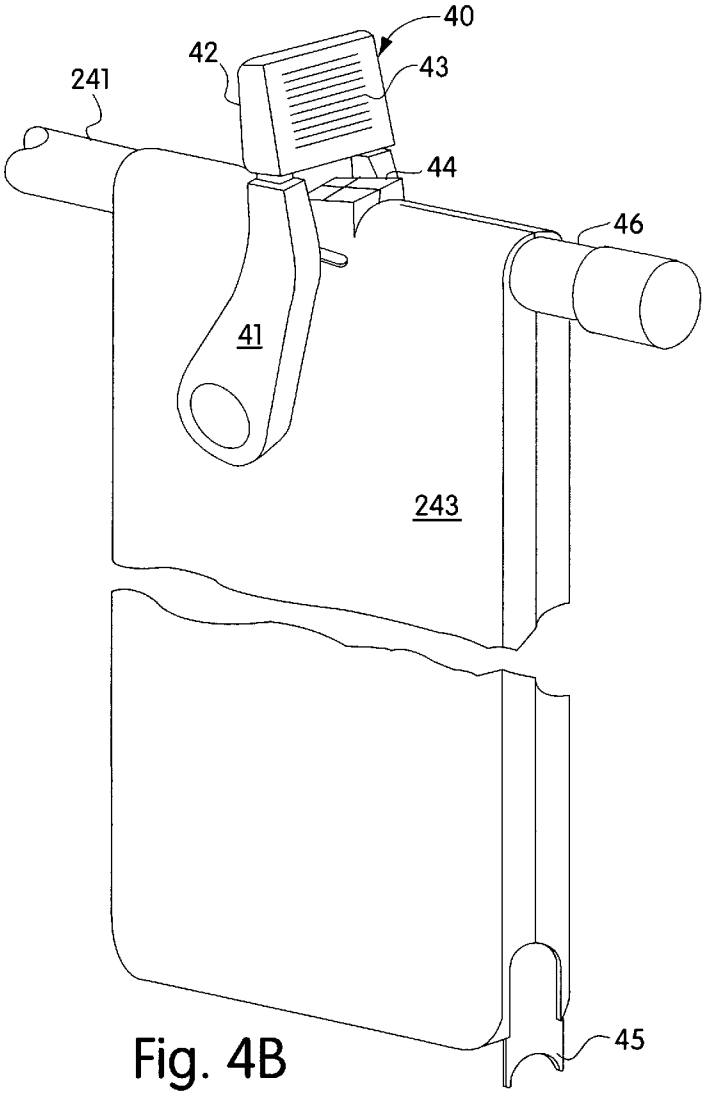
FIGS. 4A–B are illustrations of a handle for use with the safety barrier shown in FIGS. 1 and 2.
Figure 4A:
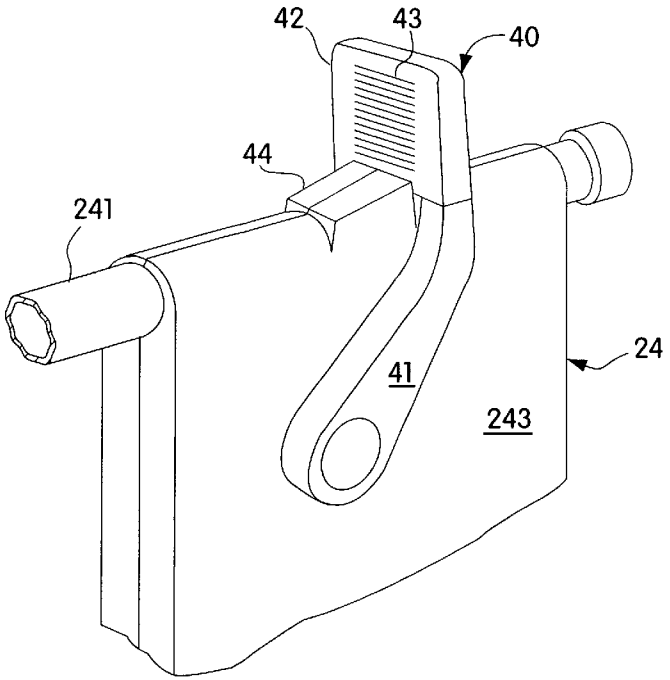

Referring now to FIGS. 4A and 4B, the barrier 10 may be provided with a handle 40 to permit the partition frame 14 to be in locking engagement with the sliding portion 163. The handle 40, in a preferred embodiment, includes parallel arms 41 pivotally connected to the housing 243 of the second member 24. The arms 41 extend upward above the housing 243 and are joined by a grip 42. The grip 42, in one embodiment, includes striations 43 on its surfaces, and can be spring loaded, so the user can securely grasp onto the grip 42 to move the handle 40 between a locked position (FIG. 4A) and an unlocked position (FIG. 4B). A member 45, such as an inverted u-shape member, which extends from the bottom of housing 243, is coupled to the handle 40 through the interior of the housing 243, and may be positioned over the portion 163 to lock the partition gate 14 and prevent it from swinging across the opening 12. It should be appreciated that the member 45 does not necessarily have to be u-shape, so long as it is capable of engaging the portion 163 to prevent the partition gate 14 from swinging. The inverted u-shape member 45, when positioned over the sliding portion 163, also permits the sliding portion 163, if so designed, to simultaneously extend with the second member 24 of the partition frame 14. To maneuver the handle 40 into the locking position shown in FIG. 4A, the grip 42 may be pushed in a direction which would place it in a substantially perpendicular relationship with the top arm 241 of the second member 24. If so desired, a section designated as 46 in FIG. 4B of the top arm 241 may be designed to be movably mounted to the handle 40. In this connection, the section 46 may be pushed against, for example, one side of a doorway when the handle 40 is pushed into the locking position to secure the barrier 10 within the doorway.

To maintain the handle 40 in this locking position, in one embodiment of the invention, a ramp 44 may be provided which, from the perspective of FIG. 4A, protrudes, at one end, partially above a bottom surface of the grip 42 and tapers away from the grip 42 towards an opposite end. In this manner, the handle 40 may be prevented from accidentally being pushed into an unlocked position. To release the handle 40 from the locking position, the grip 42 may first be grasped and pulled upward to permit the bottom surface of the grip 42 to clear the ramp 44, as shown in FIG. 4B. By pulling the handle 40 upward, the inverted u-shape member 45 may also be pulled upward to clear the portion 163. The handle 40 may next be moved over the ramp 44 to an unlocked position. Specifically, the grip 42 may be pushed from its previously substantially perpendicular position relative to the top arm 241, to a position which the parallel arms 41 of the handle 40 are substantially perpendicular to the top arm 241 of the second member 24. In this unlocked position, the inverted u-shape member 45 is released and remains cleared of the sliding portion 163. Moreover, if so designed, the section 46 will also be released from its position against the doorway when the handle 40 is in the unlocked position. Thereafter, the grip 42 may be released and returned to its previous position on the parallel arms 41, and the partition frame 14 may be free to swing back and forth across the opening 12. It should be noted that with a spring-loaded design, the grip 42 will return to its previous position simply by releasing it from the pulled position in FIG. 4B.

When the partition frame 14 is in an open position, for ease of movement over the horizontal section 162 and the extended portion 163, in one embodiment of the invention, an inclined plate 17, referring again to FIGS. 1 and 2, may be placed over the horizontal section 162 and the portion 163.

A retractable membrane 18 is attached to the first member 22 of the partition frame 14, at an end coupled to the support 16. The retractable membrane 18 includes a top edge 181, a bottom edge 182, an attached end 183, and a free end 184. In accordance with an embodiment of the present invention, the retractable membrane 18 may be positioned within the housing 223 and mounted on a tension device (not shown), such as a coiled spring mechanism, similar to a spring-loaded rod of a window shade. In this manner, when the membrane 18 is pulled from the housing 223 through a slot 225 extending substantially along the length of the housing 223, the coiled spring mechanism may be wound up, so that when the membrane 18 is released, the coiled spring can unwind to retract the membrane 18 back within the housing 223. Of course, other tensioning devices may be used, so long as they permit the membrane 18 to extend and retract from the housing 223.

To keep the membrane 18 taut along all of its edges, the membrane 18 may have its top and bottom edges 181 and 182 connected to the arms of the first member 22 and the second member 24, and its free end 184 connected to housing 243, as shown in FIG. 1. In this manner, as the partition frame 14 extends, the retractable membrane 18 may also extend therealong. Securing tabs 2231 may also be provided on housing 223 of the first member 22. When these tabs 2231 are deployed, they are permitted engage the membrane 18 at the attached end 183 to prevent the membrane 18 from further extension and to minimize any play in the membrane. If so desired, the retractable membrane 18 may be designed so that it extends independently of the partition frame 14, as illustrated in FIG. 2. In particular, the top and bottom edges of the membrane 18, including the free end 184, may remain unattached to the partition frame 14, so that only when necessary would the membrane 18 need to be extended by pulling the free end 184 toward the housing 243 and attaching the free end 184 thereto. Although the retractable membrane 18 may be positioned within housing 223, it should be understood that the membrane 18 may alternatively be positioned within housing 243 of the second member 24, and be extended toward and attached to the housing 223 of the first member 22. In a preferred embodiment of the invention, the retractable membrane 184 may be made from a flexible material, such as a durable plastic or a resilient fabric made from, for example, polyvinylchloride coated nylon threads.

As the barrier 10 of the present invention may be used to restrain and prevent passage of children across an opening, the partition frame 14, including the handle 40, and the support 16 are preferably made from a rigid and strong material, so as to withstand the weight and any force applied to the barrier 10 by the user. Examples of a preferred material include, but are not limited to, metals, such as aluminum or steel, metal composites, molded plastics, or any materials with the desired properties. The housings 223 and 243 may be made from similarly strong materials, so as to permit the housing to withstand strong impact. Moreover, the housings 223 and 243, as well as the entire barrier 10, are preferably designed with a minimal amount of corners and sharp angles, so as to reduce the incidence of injuries to the user.

The barrier 10 of FIGS. 1 and 2 may also include a mechanism for securely positioning the barrier 10 within the opening 12. The mechanism may be pressure pads 19 provided on the support 16 and the partition frame 14. In one embodiment, the pressure pads 19 may be positioned on the portion 163 and the second member 24 of the partition frame 14. Thus, when the barrier 10 is fully extended in the opening 12 of, for instance, a doorway, the pressure pads 19 may tightly engage one side of the doorway to securely maintain the barrier 10 within the opening. Pressure pads 19 may also be provided, if so desired, on the vertical section 161 of the support 16 to permit the barrier 10 to securely engage both sides of the doorway. Moreover, the sections of the support 16 and the partition frame 14 on which the pressure pads 19 are positioned may be designed to be incrementally adjustable to accommodate any warping or unevenness in the doorway. In this manner, the barrier 10 may remain securely positioned within the doorway regardless of any unevenness in the doorway. Alternatively, if the barrier 10 is to remain in the doorway for an extended period, the vertical section 161 may be provided with screws which can be rotated directly into the doorway. In such an embodiment, the support 16 may be designed not to include the horizontal section 162 and the movable portion 163.

In accordance with another embodiment of the present invention, a barrier 30 is illustrated in FIG. 3. The design of barrier 30 is substantially similar to barrier 10 of FIG. 1. The barrier 30 includes a partition frame 34, a support 36, and a membrane 38 positioned within a housing 343. The partition frame 34 includes a first member 341 and a second member 342, slidingly engaged to the first member. The position of the second member 342 relative to the first member 341 may be maintained by employing, for example, a biasing button on at least one of the members and a series of holes 3411 on the other member. In the embodiment shown in FIG. 3, the manner in which the first member 341 is connected to the housing 343 permits the first member 341 to move in a direction transverse to the plane in which the opening 12 is positioned. The second member 342, on the other hand, does not have a corresponding housing to which a free end of membrane 38 may attach. Instead, in the embodiment of FIG. 3, the free end of membrane 38 attaches directly to the member 342 along its vertical portion 3421.

The support 36 includes a vertical section 361, to which the housing 343 of the first member 341 connects, and a horizontal section 362. Connection between the support 36 and the housing 343 may be accomplished by any manner known in the art. In a preferred embodiment, the housing 343 is provided with notches 3431 designed to hook onto extensions 3611 situated on the vertical section 361 of the support 36. The support 36, similar to the partition frame 34, may also be provided with the ability to extend along the opening 12. To this end, the support 36 includes a portion 363, which is movably engaged to the horizontal section 362 for extending along the opening 12 to define a position to which the second member 342 of the partition frame 34 may extend. The movable portion 363, as shown in FIG. 3, is provided with a horizontal section 364 and a vertical section 365, and can extend from the horizontal section 362 as the second member 342 of the partition frame 34 extends away from the first member 341.

To permit the partition frame 34 to remain in a closed position to prevent passage across the opening 12, a device 38 is provided which is capable of coupling the second member 342 of the partition frame to the vertical section 365 of sliding portion 36. The device 38, designed to pivot up and down along the length of the vertical portion 3421 of the second member 342, includes notches 381 designed to hook onto protrusions 3651 situated on the vertical section 365 of the movable portion 363. The device 38, when in the locked position also permits the second member 342 to simultaneously move with the movable portion 36.

The barrier 30 further includes pressure pads 39 to maintain the barrier within the opening. As shown in FIG. 3, the pressure pads 39 may be located on the vertical section 365 of the movable portion 363, so that when the barrier 30 is fully extended in the opening 12 of, for instance, a doorway, the pressure pads 39 may tightly engage one side of the doorway to securely maintain the barrier 30 within the opening. As with barrier 10, pressure pads 39 may also be provided, if so desired, on the vertical section 361 of the support 36 to permit the barrier 30 to securely engage both sides of the doorway.

When an area needs to be temporarily closed off or an opening 12 to a restricted area needs to be temporarily blocked to restrain and protect, for example, an infant, a toddler or a pet, the barrier 10 or 30 may initially be placed within the opening 12, for instance, a doorway, with the support positioned against one side of the doorway and the partition frame in the closed position. For the ease of discussion, reference is now made to the barrier 10, with the understanding that the barrier 30 may used in a similar manner.

After the barrier 10 is placed in the doorway, the second member 24 and the portion 163 may be adjusted to extend the partition frame 14 and the support 16 along the opening 12, until the pressure pads 19 securely engage the other side of the doorway. With the barrier 10 securely engaged in the doorway, the free end 184 of the retractable membrane 18 may be pulled across the partition frame 14 and attached to the housing 243 of the second member 24. Alternatively, the free end 184 may be attached to the housing 243 prior to the extension of the second member 24 and the portion 163. The barrier 10, in this fully deployed position, can now safely close off and restrict an infant, a toddler or a pet from accessing a certain area. It should be appreciated that the rigid partition frame 14 around the retractable membrane 18 provides the barrier 10 with an added dimension of safety. In particular, an infant or a toddler, who may stray close to and who may lean on the barrier 10, will be supported by the rigid partition frame 14 and prevented from falling over the top of an otherwise flexible membrane 18. Moreover, the use of a flexible membrane 18 may minimize injuries to a toddler, should the toddler run into or bump against the membrane 18. A flexible membrane may also prevent a toddler from establishing a firm grip needed to climb over the barrier 10.

With the barrier 10 in place, if access to the restricted area is desirable, an adult user may unlock and swing the partition frame 14, in a manner similar to a door, and safely walk across the barrier 10. Once through, the partition frame 14 may be pushed back into the closed position. If, on the other hand, it is desirable to permit a pet or other objects to move across the opening 12 without removing the barrier 10, once the restriction is no longer necessary, the retractable membrane 18 may be released from the housing 243 and allowed to retract within the housing 223. By retracting the membrane 18, an opening may be created within the partition frame 14 to allow a pet to safely move across the barrier 10.

If full access across the opening 12 is desirable, the barrier 10 may be easily removed and conveniently stored in a discrete location. To remove the barrier 10 from the opening 12, the partition frame 14 may first be pushed back into the closed position.

Thereafter, the second member 24 and the portion 163 may adjustably moved toward the first member 22 until the pressure pads 19 are disengaged from the sides of the opening 12. The second member 24 and the portion 163 may continue to be pushed toward the first member 22 until the barrier 10 reaches its a compact size for storage.

While the invention has been described in connection with the specific embodiments thereof, it will be understood that it is capable of further modification. For example, should a restraint across the tailgate section of a truck is desirable, the extendable barrier of the present invention can be easily adapted to fit across the tailgate section. Moreover, should it be desirable to permit fluid to flow across the membrane, for instance across the barrier in the tailgate section, the membrane can be modified to include perforations. Furthermore, this application is intended to cover any variations, uses, or adaptations of the invention, including such departures from the present disclosure as come within known or customary practice in the art to which the invention pertains, and as fall within the scope of the appended claims.

What is claimed is:

1. A barrier to prevent passage through an opening, the barrier comprising:

a partition frame extendable along its length for placement within the opening;

a support connected to the frame to maintain the frame within the opening;

a mechanism having a membrane retractable thereabout, which mechanism being attached to the frame at an end connected to the support, the membrane being deployable toward an end of the frame opposite the support, so as to form a partition across the opening; and a locking mechanism, wherein the locking mechanism includes:

a member capable of being moved into a locking engagement with a portion of the barrier; and a handle coupled to the member for moving the member between a first locking position, wherein the handle is substantially parallel to the member, and a second unlocked position, wherein the handle is transverse to the member.

2. A barrier of claim 1, wherein the locking mechanism further comprises means for securing the handle in the substantially parallel position, so as to maintain the member in locking engagement with the barrier.

3. A barrier of claim 1, wherein the handle includes a portion, which when pulled upward in a direction of movement of the member, permits the handle to clear the means for securing the handle, and allows the handle to be moved to its transverse position to disengage the member from the barrier.

4. A reinforced barrier comprising:

a mechanism having a membrane retractable thereabout for placement across an opening;

a rigid extendable frame placed about a periphery of the membrane for reinforcing the periphery of the membrane, the frame to which the membrane is attached is capable of being adjusted to match the position of the membrane across the opening;

a support member coupled to the frame for maintaining the frame across the opening; and;

a locking mechanism, wherein the locking mechanism includes:

a member capable of being moved into a locking engagement with a portion of the barrier; and a handle coupled to the member for moving the member between a first locking position, wherein the handle is substantially parallel to the member, and a second unlocked position, wherein the handle is transverse to the member.

* * * * *